US006820523B1

(12) United States Patent
Chen

(10) Patent No.: US 6,820,523 B1
(45) Date of Patent: Nov. 23, 2004

(54) TOOL HAVING DETACHABLE HANDLE

(76) Inventor: Chia Yu Chen, P.O. Box 63-99, Taichung (TW), 406

( * ) Notice: Subject to any disclaimer, the term of this patent is extended or adjusted under 35 U.S.C. 154(b) by 0 days.

(21) Appl. No.: 10/755,788

(22) Filed: Jan. 9, 2004

(51) Int. Cl.[7] ..... B25B 23/16

(52) U.S. Cl. ..... 81/177.2; 81/177.1; 81/177.8; 81/489; 81/491

(58) Field of Search ..... 81/177.2, 177.1, 81/177.8, 489, 491

(56) References Cited

U.S. PATENT DOCUMENTS

| | | | | |
|---|---|---|---|---|
| 2,158,728 A | | 5/1939 | Peters | |
| 2,439,071 A | | 4/1948 | Basham | |
| 2,871,899 A | | 2/1959 | Coyle et al. | |
| 2,985,209 A | | 5/1961 | Novelo | |
| 4,169,312 A | | 10/1979 | Mar | |
| 4,391,043 A | | 7/1983 | Sizemore et al. | 30/330 |
| 4,463,788 A | * | 8/1984 | Corona et al. | 81/177.4 |
| 5,964,132 A | * | 10/1999 | Chen | 81/439 |
| 5,974,915 A | * | 11/1999 | Chou | 81/63.1 |

* cited by examiner

*Primary Examiner*—Lee D. Wilson
*Assistant Examiner*—Alvin J. Grant

(57) ABSTRACT

A tool includes a handle having a chamber to receive a block of a tool member which is arranged to be rotated and driven by the handle. A control ferrule is engaged onto the handle and includes a catch engageable with the block of the tool member, to detachably secure the tool member to the handle. The block includes a peripheral groove to receive the catch, and to secure the block of the tool member to the handle. The block includes a peripheral rib having a notch to receive the catch, and to allow the catch to be engaged into the peripheral groove of the block via the notch of the peripheral rib.

13 Claims, 4 Drawing Sheets

TOOL HAVING DETACHABLE HANDLE

BACKGROUND OF THE INVENTION

1. Field of the Invention

The present invention relates to a tool, and more particularly to a tool having a detachable or changeable handle.

2. Description of the Prior Art

Various kinds of typical tools may comprise a handle attached to a tool member for rotating or driving or carrying the tool member.

For example, U.S. Pat. No. 2,871,899 to Coyle et al., and U.S. Pat. No. 2,985,209 to Novelo disclose two of the typical tool handles each having a screw driver shank detachably attached thereto with ribs or nibs. However, the screw driver shanks may not be solidly secured to the handles.

U.S. Pat. No. 2,158,728 to Peters discloses another typical tool handle having a screw driver shank detachably attached thereto with a slidable locking member. However, the screw driver shank may not be solidly secured to the handle with the slidable locking member.

U.S. Pat. No. 2,439,071 to Basham, and U.S. Pat. No. 4,169,312 to Mar disclose two of the typical knives or hatchets each having a knife blade or a hatchet member detachably attached thereto with a clamping member. However, the handles may not apply a great driving or rotating torque against the knife blades or the hatchet members.

U.S. Pat. No. 4,391,043 to Sizemore et al. discloses another typical knife having a knife blade detachably attached thereto with two separate grips that are required to be secured together with a number of fastener members. However, it takes time to thread and to unthread the fastener members from the grips.

The present invention has arisen to mitigate and/or obviate the afore-described disadvantages of the conventional tools.

SUMMARY OF THE INVENTION

The primary objective of the present invention is to provide a tool including a detachable or changeable handle that may be solidly secured to the tool member.

In accordance with one aspect of the invention, there is provided a tool comprising a handle including a chamber formed therein, a tool member including a block received in the chamber of the handle, and attached to the handle, and arranged to be rotated and driven by the handle, and a control ferrule engaged onto the handle and including a catch extended therein and engageable with the block of the tool member, to detachably secure the tool member to the handle.

The block includes a peripheral groove formed therein to receive the catch, and to secure the block of the tool member to the handle. The block includes a peripheral rib provided thereon to define the peripheral groove thereof, and to engage with the catch, and to retain the catch in the peripheral groove of the block.

The peripheral rib of the block includes a notch formed in the peripheral rib, to receive the catch, and to allow the catch to be engaged into the peripheral groove of the block via the notch of the peripheral rib. The block includes a protrusion extended into the peripheral groove thereto, to engage with the catch, and to prevent the catch from being disengaged from the peripheral groove of the block via the notch of the peripheral rib.

The tool member includes a cap extended therefrom and engaged with the handle, to position the tool member to the handle. The tool member includes a non-circular stem extended therefrom and engaged into the handle, to prevent the tool member from being rotated relative to the handle.

The handle includes a wall extended therefrom to form the chamber thereof, the control ferrule is engaged onto the wall of the handle. The wall includes a slot formed therein and communicating with the chamber of the handle, to receive the catch, and to allow the catch to be engaged with the block of the tool member.

The wall includes a peripheral channel formed therein and communicating with the slot of the wall, the control ferrule includes a peripheral bulge extended therefrom and engaged into the peripheral channel of the wall, to rotatably attach the control ferrule to the wall of the handle.

The wall includes an inclined surface formed thereon to engage with the peripheral bulge of the control ferrule, and to allow the peripheral bulge of the control ferrule to be forced into the peripheral channel of the wall via the inclined surface of the wall.

The wall includes an opening formed therein and communicating with the slot of the wall, to allow the catch to engage into the slot of the wall via the opening of the wall. The wall includes two end fences to define the slot thereof, the opening of the wall is arranged between the end fences of the wall. The handle includes an outer peripheral shoulder formed by the wall, to rotatably receive the control ferrule.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
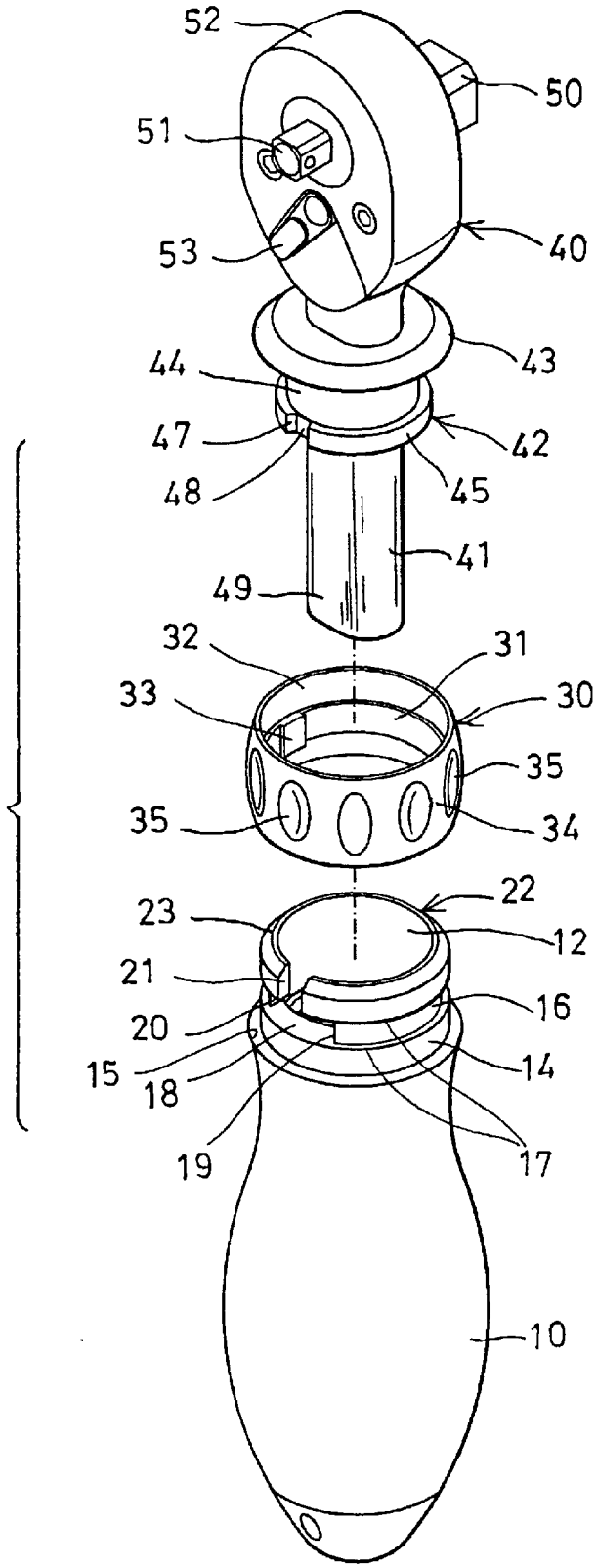
FIG. 1 is a partial exploded view of a tool in accordance with the present invention.
Figure 2:
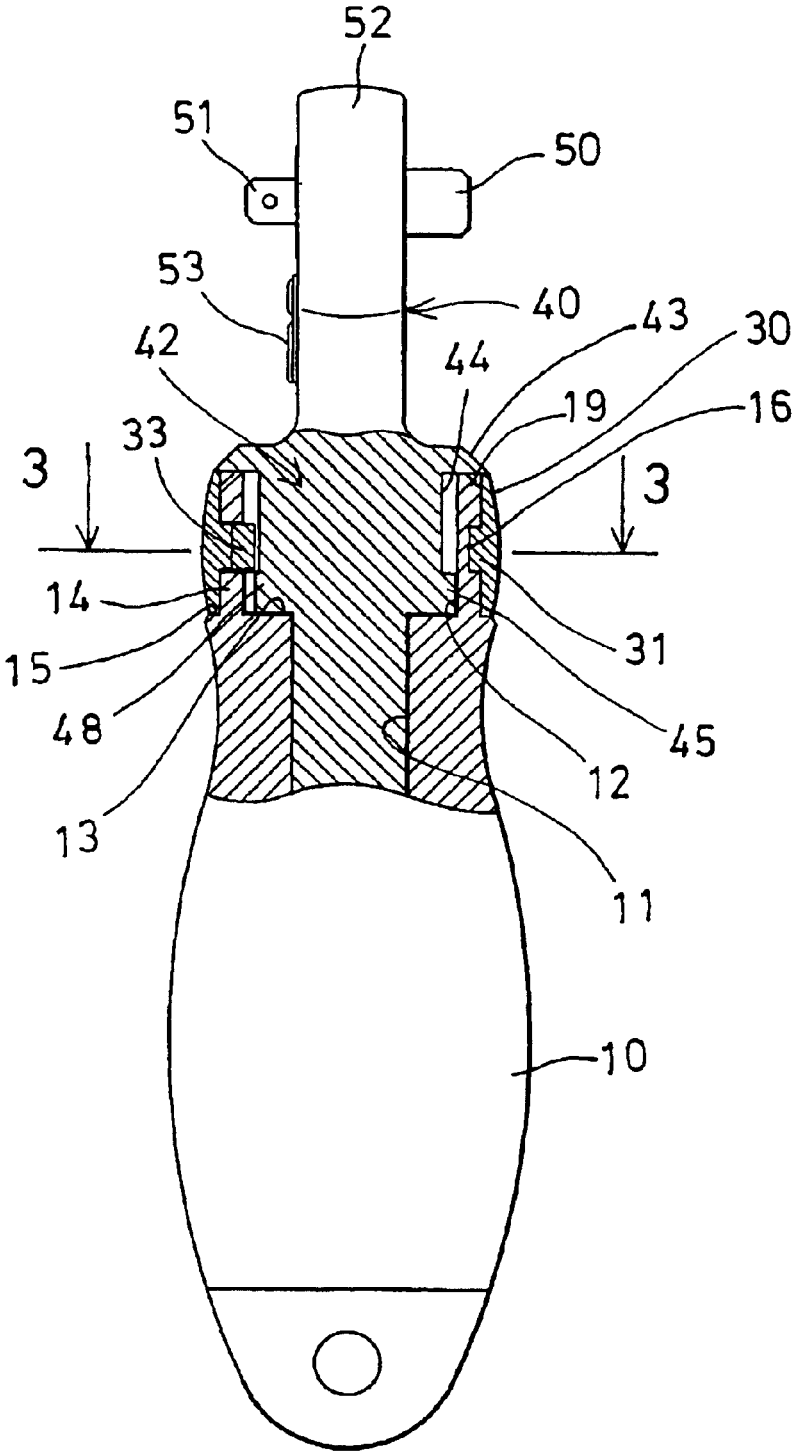
FIG. 2 is a side view of the tool, in which a portion of the tool is cut off to show an inner structure of the tool.
Figure 3:
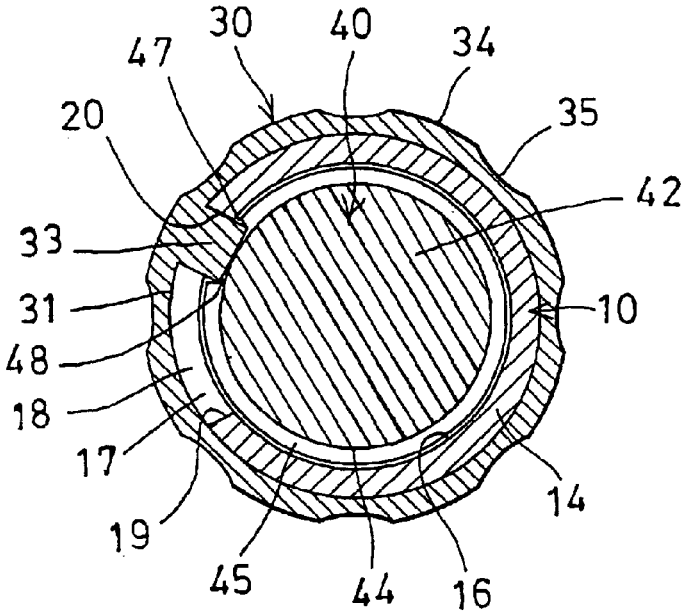
FIG. 3 is a cross sectional view taken along lines 3—3 of FIG. 2.

Referring to the drawings, and initially to FIGS. 1–3, a tool in accordance with the present invention comprises a handle 10 including a bore 11 formed in the inner portion thereof, and a chamber 12 formed in the upper portion thereof and communicating with the bore 11 thereof. The chamber 12 of the handle 10 includes an inner diameter greater than that of the bore 11 of the handle 10, to form or define an inner peripheral shoulder 13 between the chamber 12 and the bore 11 thereof.

For example, the handle 10 includes an annular or peripheral wall 14 extended upwardly from the upper portion thereof, to form or define the chamber 12 in the inner portion thereof, and to form or define an annular or outer peripheral shoulder 15 in the outer portion thereof. The wall 14 includes an annular or peripheral channel 16 formed in the outer peripheral portion thereof and defined between two opposite flanges 17.

The wall 14 further includes a slot 18 formed therein and communicating with the chamber 12 of the handle 10 and the peripheral channel 16 of the wall 14 of the handle 10, and defined between two end fences 19, 20. The wall 14 further includes an opening 21 formed in the upper portion 22 thereof and communicating with the chamber 12 of the handle 10 and the peripheral channel 16 of the wall 14 of the handle 10, and includes an inclined surface 23 formed in the upper portion 22 thereof.

The opening 21 of the wall 14 preferably includes a width smaller than that of the slot 18 of the wall 14, and preferably located or arranged between the end fences 19, 20 of the wall 14.

A control ferrule 30 includes an annular or peripheral bulge 31 extended radially and inwardly from an inner peripheral surface 32 thereof, for engaging into the peripheral channel 16 of the wall 14 of the handle 10 by such as forcing the peripheral bulge 31 of the control ferrule 30 over the inclined surface 23 of the wall 14 of the handle 10, for allowing the peripheral bulge 31 of the control ferrule 30 to be slidably received in the peripheral channel 16 of the wall 14 of the handle 10.

Figure 4:
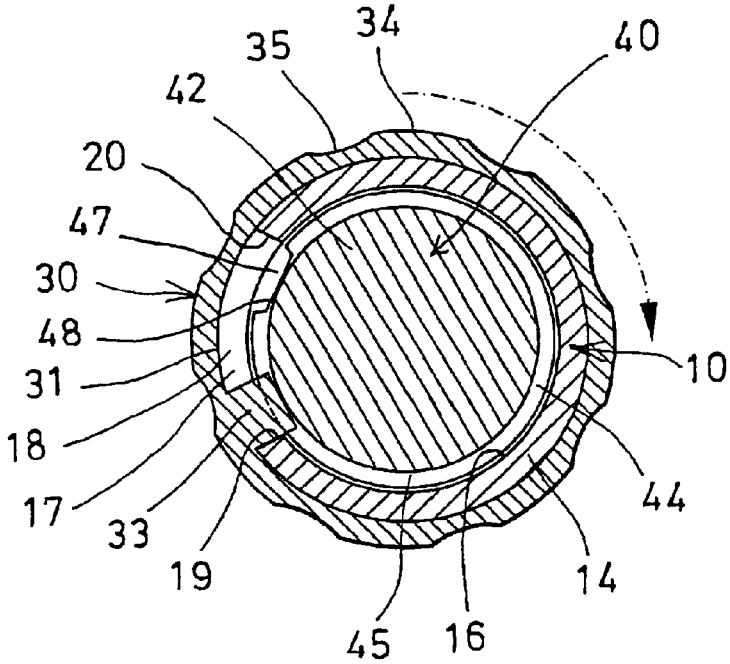
FIG. 4 is a cross sectional view similar to FIG. 3, illustrating the operation of the tool.

The control ferrule 30 includes a projection or a catch 33 extended radially and inwardly from the peripheral bulge 31 for engaging into the slot 18 of the wall 14 via the opening 21 of the wall 14, and thus for allowing the peripheral bulge 31 of the control ferrule 30 to be engaged into the peripheral channel 16 of the wall 14 of the handle 10. The end fences 19, 20 of the wall 14 are engageable with the catch 33 of the control ferrule 30 (FIGS. 3, 4) to limit the catch 33 to slide within the slot 18 of the wall 14.

It is preferable that the control ferrule 30 includes an inner diameter equals to or slightly greater than the outer diameter of the wall 14 of the handle 10, to allow the control ferrule 30 to be rotatably engaged onto the wall 14, and to be rotatably engaged with the peripheral shoulder 15 of the wall 14 (FIG. 2). The control ferrule 30 preferably includes one or more swellings 34 and/or one or more depressions 35 formed in the outer peripheral portion thereof for facilitating the rotation of the control ferrule 30 relative to the wall 14 of the handle 10.

A tool member 40 includes a stem 41 extended from one end thereof for engaging into the bore 11 of the handle 10, a block 42 formed or provided in the middle portion thereof for engaging into the chamber 12 of the handle 10, a cap 43 provided in the middle portion thereof or extended from the block 42 for engaging with the wall 14, and for solidly retaining or positioning the tool member 40 to the handle 10.

The tool member 40 includes one or more driving shanks 50, 51 provided on the other end 52 thereof with a usual ratchet mechanism (not shown) for driving fasteners or tool extensions (not shown) or the like, and a knob 53 for actuating the usual ratchet mechanism (not shown) to determine or to change the driving directions of the driving shanks 50, 51.

It is preferable that the stem 41 includes a non-circular cross section, such as having one or more flat surfaces 49 formed thereon (FIG. 1), for engaging with the corresponding non-circular bore 11 of the handle 10, and for allowing the tool member 40 to be solidly rotated or driven by the handle 10.

The tool member 40 includes an annular or peripheral groove 44 formed in the outer peripheral portion of the block 42, and defined by an outer peripheral rib 45 and/or defined between the peripheral rib 45 and the cap 43, to slidably receive the catch 33 of the control ferrule 30 (FIGS. 2–4), and includes a notch 47 formed in the peripheral rib 45, to receive the catch 33 and to allow the catch 33 to engage into the peripheral groove 44 of the block 42 of the tool member 40.

When the control ferrule 30 is rotated relative to the tool member 40 and the handle 10 to disengage the catch 33 from the notch 47 of the peripheral rib 45, the tool member 40 may be solidly secured to the handle 10 and may be prevented from being disengaged from the handle 10.

It is to be noted that the tool member 40 may not be rotated relative to the handle 10, and the control ferrule 30 may be rotatably received in the peripheral shoulder 15 of the wall 14, and may be suitably shielded within the cap 43, such that the control ferrule 30 will not be rotated relative to the tool member 40 and the handle 10 inadvertently. In addition, the catch 33 may be arranged to be force-fitted to or with the block 42 of the tool member 10, to prevent the catch 33 from being disengaged from the block 42 of the tool member 10 via the notch 47 of the peripheral rib 45.

The tool member 40 may further include a protrusion 48 slightly extended into the notch 47 of the block 42, to engage with the catch 33, and to allow the catch 33 to be engaged into the peripheral groove 44 of the block 42 of the tool member 40 via the notch 47 of the peripheral rib 45, but to solidly retain the catch 33 within the peripheral groove 44 of the block 42 after the catch 33 moves over the protrusion 48, and thus to prevent the catch 33 from being disengaged from the notch 47 of the peripheral rib 45 inadvertently.

Figure 5:
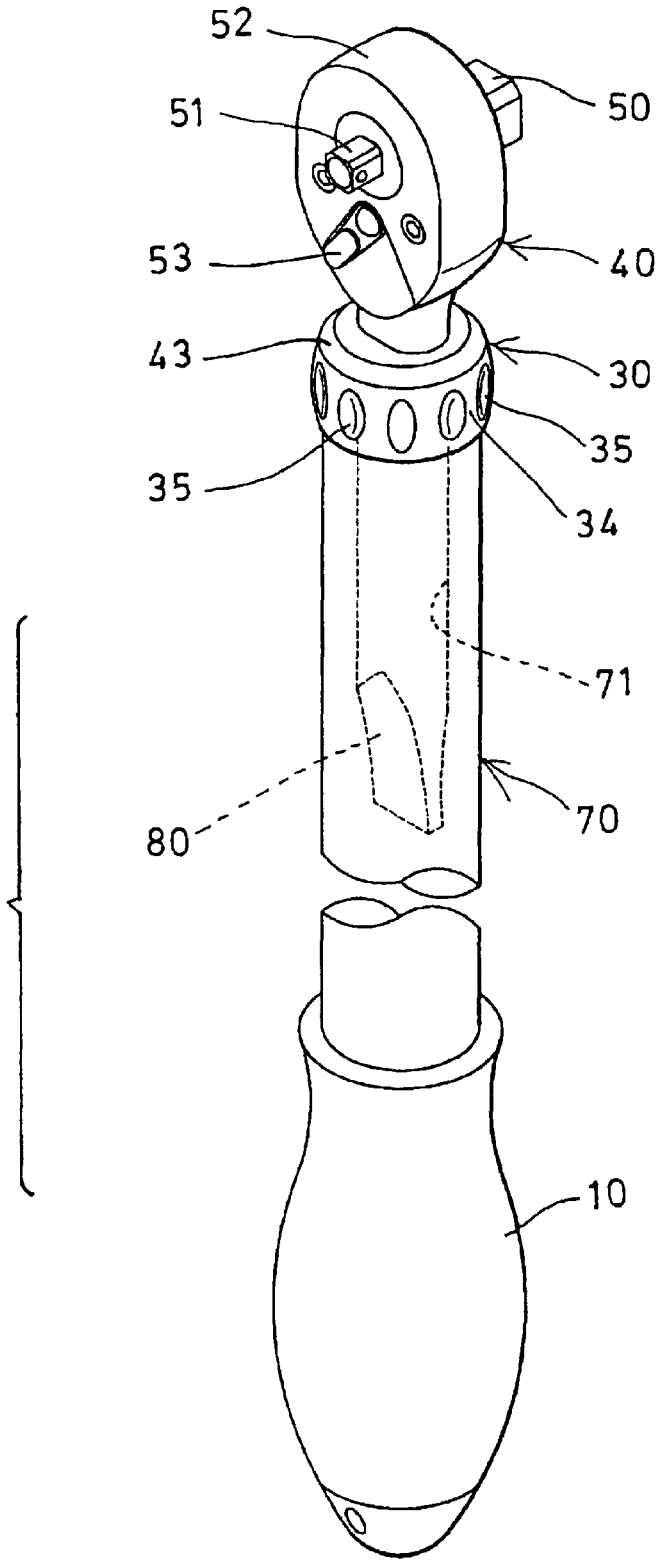
FIG. 5 is a perspective view illustrating the other arrangement of the tool.

Referring next to FIG. 5, the handle 10 may further include a rod or an extension 70 formed or provided therein and having a longitudinal cavity 71 formed therein to receive an elongate tool stem 80 of the tool member 40, for example.

Accordingly, the tool in accordance with the present invention includes a detachable or changeable handle that may be solidly secured to the tool member.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A tool comprising:

a handle including a chamber formed therein, a tool member including a block received in said chamber of said handle, and attached to said handle, and arranged to be rotated and driven by said handle, and said tool member including a non-circular stem extended therefrom and engaged into said handle, to prevent said tool member from being rotated relative to said handle, and a control ferrule engaged onto said handle and including a catch extended therein and engageable with said block of said tool member, to detachably secure said tool member to said handle.

2. The tool as claimed in claim 1, wherein said block includes a peripheral groove formed therein to receive said catch, and to secure said block of said tool member to said handle.

3. The tool as claimed in claim 1, wherein said tool member includes a cap extended therefrom and engaged with said handle, to position said tool member to said handle.

4. The tool as claimed in claim 1, wherein said handle includes a wall extended therefrom to form said chamber thereof, said control ferrule is engaged onto said wall of said handle.

5. The tool as claimed in claim 4, wherein said wall includes a slot formed therein and communicating with said chamber of said handle, to receive said catch, and to allow said catch to be engaged with said block of said tool member.

6. The tool as claimed in claim 5, wherein said wall includes a peripheral channel formed therein and communicating with said slot of said wall, said control ferrule includes a peripheral bulge extended therefrom and engaged into said peripheral channel of said wall, to rotatably attach said control ferrule to said wall of said handle.

7. The tool as claimed in claim 4, wherein said wall includes an opening formed therein and communicating with said slot of said wall, to allow said catch to engage into said slot of said wall via said opening of said wall.

8. The tool as claimed in claim 7, wherein said wall includes two end fences to define said slot thereof, said opening of said wall is arranged between said end fences of said wall.

9. The tool as claimed in claim 4, wherein said handle includes an outer peripheral shoulder formed by said wall, to rotatably receive said control ferrule.

10. A tool comprising:

a handle including a chamber formed therein, a tool member including a block received in said chamber of said handle, and attached to said handle, and arranged to be rotated and driven by said handle, said block including a peripheral groove formed therein, a control ferrule engaged onto said handle and including a catch extended therein and engageable into said peripheral groove of said block of said tool member, to detachably secure said tool member to said handle, and said block including a peripheral rib provided thereon to define said peripheral groove thereof, and to engage with said catch, and to retain said catch in said peripheral groove of said block.

11. The tool as claimed in claim 10, wherein said peripheral rib of said block includes a notch formed in said peripheral rib, to receive said catch, and to allow said catch to be engaged into said peripheral groove of said block via said notch of said peripheral rib.

12. The tool as claimed in claim 11, wherein said block includes a protrusion extended into said peripheral groove thereto, to engage with said catch, and to prevent said catch from being disengaged from said peripheral groove of said block via said notch of said peripheral rib.

13. A tool comprising:

a handle including a chamber formed therein, and including a wall extended therefrom to form said chamber thereof, said wall including a slot formed therein and communicating with said chamber of said handle, and said wall including a peripheral channel formed therein and communicating with said slot of said wall, a tool member including a block received in said chamber of said handle, and attached to said handle, and arranged to be rotated and driven by said handle, a control ferrule engaged onto said wall of said handle and including a catch extended therein and engageable into said slot of said wall and engageable with said block of said tool member, to detachably secure said tool member to said handle, and said control ferrule including a peripheral bulge extended therefrom and engaged into said peripheral channel of said wall, to rotatably attach said control ferrule to said wall of said handle, and said wall including an inclined surface formed thereon to engage with said peripheral bulge of said control ferrule, and to allow said peripheral bulge of said control ferrule to be forced into said peripheral channel of said wall via said inclined surface of said wall.

* * * * *